US008478139B2

(12) United States Patent
Kim

(10) Patent No.: US 8,478,139 B2
(45) Date of Patent: Jul. 2, 2013

(54) CONTROL METHOD OF HOST DEVICE REPORTING ERROR INFORMATION TO A USER, IMAGE FORMING SYSTEM, IMAGE FORMING APPARATUS AND HOST DEVICE EMPLOYING THE SAME

(75) Inventor: Geon-hoon Kim, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 276 days.

(21) Appl. No.: 12/493,371

(22) Filed: Jun. 29, 2009

(65) Prior Publication Data

US 2010/0054762 A1 Mar. 4, 2010

(30) Foreign Application Priority Data

Sep. 2, 2008 (KR) ..... 10-2008-0086502

(51) Int. Cl.
*G03G 15/00* (2006.01)

(52) U.S. Cl.
USPC ..... 399/8; 399/10

(58) Field of Classification Search
USPC ..... 399/8, 10, 18, 19, 20, 21; 358/1.9
See application file for complete search history.

(56) References Cited

U.S. PATENT DOCUMENTS

| | | | | |
|---|---|---|---|---|
| 4,734,747 | A * | 3/1988 | Okuda et al. | 399/23 |
| 5,127,012 | A * | 6/1992 | Hiliger | 714/46 |
| 2007/0014614 | A1 * | 1/2007 | Yoshida | 400/62 |
| 2007/0220353 | A1 * | 9/2007 | Iura et al. | 714/39 |

FOREIGN PATENT DOCUMENTS

| | | |
|---|---|---|
| JP | 7-319343 | 12/1995 |
| JP | 11-100148 | 4/1999 |
| JP | 2004-12599 | 1/2004 |
| JP | 2005-125678 | 5/2005 |
| KR | 2005-63241 | 6/2005 |

OTHER PUBLICATIONS

Korean Office Action issued Sep. 28, 2012 in corresponding Korean Patent Application No. 10-2008-0086502.
Korean Decision of Rejection mailed Mar. 11, 2013 in counterpart Korean application 10-2008-0086502.

* cited by examiner

*Primary Examiner* — Walter L Lindsay, Jr.
*Assistant Examiner* — Billy J Lactaoen
(74) *Attorney, Agent, or Firm* — Staas & Halsey LLP

(57) ABSTRACT

A control method of a host device that avoids an error part through a user interface unit to use an image forming apparatus, an image forming system, an image forming apparatus and a host device employing the same, the control method including: requesting error information from the image forming apparatus in the host device; and displaying the error information of the image forming apparatus received from the image forming apparatus on a user interface unit of the host device.

21 Claims, 6 Drawing Sheets

FIG. 4

51 53 55

| LOCATION OF ERROR | | TYPE OF ERROR | NUMBER OF ERRORS OCCURRED | OCCURRENCE DATE | REPLACED JOB INFORMATION |
|---|---|---|---|---|---|
| Paper Path | Where | Paper Jam1 Feed | 2 | When | info |
| | Where | Paper Jam1 Exit | 0 | When | info |
| | Where | Paper Jam2 Exit | 0 | When | info |
| | Where | Duplex Jam0 | 0 | When | info |
| Tray 1 | Where | Tray1 Jam | 2 | When | info |
| Tray 2 | Where | Tray2 Jam | 0 | When | info |
| Tray 3 | Where | Tray3 Jam | 0 | When | info |
| Fuser | Where | Fuser Unit Error | 0 | When | info |
| | Where | Fuser Thermistor Error | 0 | When | info |
| | Where | Fuser Low Heat Error | 1 | When | info |
| LSU | Where | LSU Y Error | 0 | When | info |
| | Where | LSU M Error | 0 | When | info |
| | Where | LSU C Error | 0 | When | info |
| | Where | LSU K Error | 0 | When | info |
| DADF | Where | Feed Error | 1 | When | info |
| Finisher | Where | Punch Error | 0 | When | info |
| | Where | Stapler Error | 0 | When | info |
| | Where | Top Tray Error | 0 | When | info |
| | Where | Stacker Tray Lifting Error | 0 | When | info |
| Booklet Maker | Where | BM Staple Error | 2 | When | info |
| Inserter | Where | Inserter Error | 1 | When | info |

FIG. 5

61 63

| TRAY PAPER TRAY | SIZE PAPER SIZE | ERROR STATUS | ERROR INFORMATION | ERROR STATUS CHANGE |
|---|---|---|---|---|
| Auto Tray | - | AVAILABLE | - | - |
| MULTI-PURPOSE Tray | A4 | AVAILABLE | ERROR INFORMATION | CHANGE |
| Tray 1 | A3 | NOT AVAILABLE | ERROR INFORMATION | CHANGE |
| Tray 2 | B4 | AVAILABLE | ERROR INFORMATION | CHANGE |
| Tray 3 | B4 | AVAILABLE | ERROR INFORMATION | CHANGE |
| HCF | A4 | NOT AVAILABLE | ERROR INFORMATION | CHANGE |

CONTROL METHOD OF HOST DEVICE REPORTING ERROR INFORMATION TO A USER, IMAGE FORMING SYSTEM, IMAGE FORMING APPARATUS AND HOST DEVICE EMPLOYING THE SAME

CROSS-REFERENCE TO RELATED APPLICATION

This application claims the benefit of Korean Patent Application No. 2008-86502, filed Sep. 2, 2008, in the Korean Intellectual Property Office, the disclosure of which is incorporated herein by reference.

BACKGROUND OF THE INVENTION

1. Field of the Invention

Aspects of the present invention relate to a control method of a host device, an image forming system, an image forming apparatus, and a host device employing the same, and more particularly, to a control method of a host device that avoids an error part of an image forming apparatus through a user interface unit to use the image forming apparatus, an image forming system, an image forming apparatus, and a host device employing the same.

2. Description of the Related Art

Generally, an image forming apparatus is connected to a host device through a network (such as a local area network (LAN)), and operates according to a control command of the host device. Examples of the image forming apparatus include a printer, a scanner, a photocopier, a facsimile, and a multi-function device. An electrophotographic image forming apparatus will be described as an example of the image forming apparatus. Moreover, examples of the host device include a general-purpose host computer such as a personal computer or a laptop computer. The host device commands the image forming apparatus through a printer driver to print documents, set a printing environment, etc.

The electrophotographic image forming apparatus forms an image on a print medium (such as paper or a transparency) supplied by a paper feeding cassette thorough charging, exposing, developing, transferring, and fusing processes. With the recent trend of higher performance, higher capacity, and multiple operations, a configuration of image forming apparatuses is gradually becoming more complicated. The complicated configuration of the image forming apparatus results in potential errors and failures. For example, if a pickup roller of one of a plurality of print medium feeding cassettes in a network image forming apparatus is worn, an error may occur due to a print medium jam.

If a user does not recognize the worn pickup roller and continues to use the print medium feeding cassette having the worn pickup roller, the print medium jam occurs and a print operation of the image forming apparatus is suspended. Here, if a user simply removes the jammed print medium and executes the print job again, the jam may occur again. Accordingly, a user who does not recognize the cause of the error may be inconvenienced when using the image forming apparatus. Thus, there is a need for a method to notify a user, who desires to use a print medium feeding cassette causing repetitive jams, of an error history before a print operation so as to avoid using the concerned print medium feeding cassette.

SUMMARY OF THE INVENTION

Aspects of the present invention provide a control method and a system of an image forming apparatus that notify a user of an error through a user interface unit of a host device if an image forming apparatus has the error, and allows a user to use the image forming apparatus by avoiding an error part if a partial error occurs, an image forming apparatus and a host device employing the same.

According to an aspect of the present invention, there is provided a control method of a host device connected to an image forming apparatus, the control method including: requesting, by the host device, error information from the image forming apparatus; and displaying the received error information on a user interface unit of the host device, wherein the error information comprises an error history of the image forming apparatus.

The error information may further include an error history of the image forming apparatus and information about an availability of each job mode of the image forming apparatus.

The error history of the image forming apparatus may include a location in the image forming apparatus of an error, a type of the error, and/or a number of times that the error has occurred.

The displaying of the received error information may include displaying the error information for the job mode to be set in the host device.

The displaying of the received error information includes displaying the job mode corresponding to an error part of the image forming apparatus on the user interface unit.

The error information may be supplied by a storage unit of the image forming apparatus storing the error information of the image forming apparatus in response to the host device requesting the error information of the image forming apparatus.

The error information that is stored in the storage unit may be updated according to an error that is determined by the image forming apparatus when the image forming apparatus operates.

The error information that is stored in the storage unit may be changed or initialized according to a user input to the host device.

The user interface unit may include a user interface of a printer driver and/or a user interface of an application executed by the host.

According to another aspect of the present invention, there is provided an image forming system to provide error information to a user, the image forming system including: an image forming apparatus including: a storage unit to store the error information of the image forming apparatus; and a first controller to transmit the stored error information; and the host device including: a receiving unit to receive the transmitted error information, a second controller to provide an operation command for the image forming apparatus and to set an operation of the image forming apparatus; and a user interface unit to display the received error information of the image forming apparatus according to a job mode of the image forming apparatus.

The error information may include information about an error history and/or an availability of each job mode of the image forming apparatus.

The error history of the image forming apparatus may include a location of the error, a type of the error, and/or a number of errors.

A replaced job mode or an available job mode may be displayed for an error part on the user interface unit.

The error information that is stored in the storage unit may be updated based on error information generated when the image forming apparatus operates.

The error information that is stored in the storage unit may be changed or initialized according to a user input to the host device.

The user interface unit may include a user interface of a printer driver and/or a user interface of an application that is executed by the host device.

According to another aspect of the present invention, there is provided an image forming apparatus connected to a host device having a user interface unit displaying information supplied by the image forming apparatus, the image forming apparatus including: a storage unit to store error information of the image forming apparatus; and a controller to supply the stored error information to the host device so that the error information is displayable on the user interface unit according to a job mode of the image forming apparatus.

The error information may include an error history including a location of the error, a type of the error, and a number of errors; and/or information about an availability of each operation mode.

The error information that is stored in the storage unit may be updated according to error information generated when the image forming apparatus operates.

The error information that is stored in the storage unit may be changeable or initializable.

According to still another aspect of the present invention, there is provided a host device connected to an image forming apparatus that supplies error information to the host device, the host device including: a controller to provide an operation command for the image forming apparatus that sets an operation of the image forming apparatus; and a user interface unit to display the supplied error information of the image forming apparatus according to a job mode of the image forming apparatus.

A replaced job mode or an available job mode may be displayed for an error part of the image forming apparatus on the user interface unit.

The user interface unit may include a user interface of a printer driver and/or a user interface of an application executed by the host device.

According to yet another aspect of the present invention, there is provided a control method of a host device connected to an image forming apparatus, the control method including: requesting, by the host device, error information from the image forming apparatus; and displaying the received error information on a user interface unit of the host device, wherein the error information comprises an error history of the image forming apparatus.

According to another aspect of the present invention, there is provided a host device that is connected to an image forming apparatus that supplies error information to the host device, the host device including: a controller to provide an operation command for the image forming apparatus and sets an operation of the image forming apparatus; and a user interface unit to display the supplied error information of the image forming apparatus, wherein the error information comprises an error history of the image forming apparatus.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which:

FIGS. 2 to 4 illustrate examples of menu screens displayed by a user interface (UI) unit of a host device connected to a network image forming apparatus according to embodiments of the present invention;

FIG. 5 illustrates an example of a menu screen of a user interface (UI) unit of a host device displaying information about print medium trays among job selection information supplied to a user about a network image forming apparatus according to an embodiment of the present invention.

DETAILED DESCRIPTION OF THE EMBODIMENTS

Figure 1:
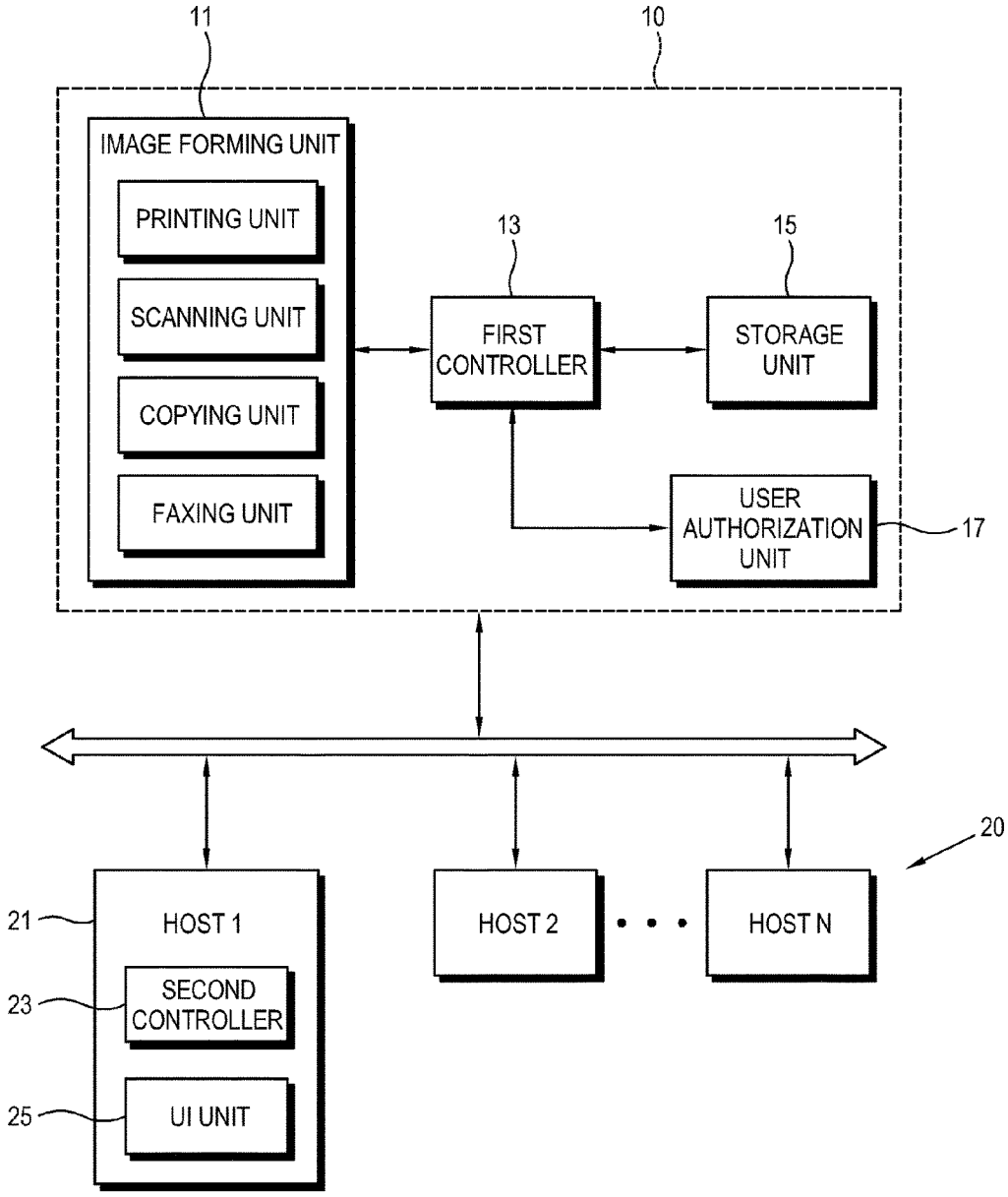
FIG. 1 is a schematic block diagram of an image forming system according to an embodiment of the present invention.

Reference will now be made in detail to the present embodiments of the present invention, examples of which are illustrated in the accompanying drawings, wherein like reference numerals refer to the like elements throughout. The embodiments are described below in order to explain the present invention by referring to the figures.

FIG. 1 is a schematic block diagram of an image forming system according to an embodiment of the present invention. Referring to FIG. 1, the image forming system includes an image forming apparatus 10 that prints a document and a host device 20 that is connected to the image forming apparatus 10 through a network (such as a local area network (LAN) or the Internet). It is understood that aspects of the present invention are not limited to a host device 20 connected to an image forming apparatus 10 through a network. That is, according to other examples, the host device 20 may be connected to the image forming apparatus directly (for example, through a printer cable or USB cable) or via other connection methods (for example, infrared, Bluetooth, etc.).

The image forming apparatus 10 includes an image forming unit 11 to perform image forming operations, a storage unit 15 to store error information about the image forming apparatus 10, and a first controller 13 to control the image forming unit 11 and to supply the error information stored in the storage unit 15 to the host device 20. Though an electrophotographic image forming apparatus is provided as the image forming apparatus 10 in the present embodiment, it is understood that aspects of the present invention are not limited thereto, and are applicable to any image forming apparatus that forms an image on a print medium. In this case, the image forming unit 11 includes a printing unit, a scanning unit, a copying unit, and/or a faxing unit. Moreover, the image forming apparatus 10 may be a multi-operation device that performs at least two operations from among printing, scanning, copying, and faxing operations.

The host device 20 may be a general-purpose host computer (such as a personal computer or a laptop computer), a mobile phone, a personal digital assistant, or any computing device that supports a printing operation (i.e., that can transmit print data to an image forming apparatus 10). The host device 20 commands the image forming apparatus 10 through a printer driver to print documents, set a printing environment, etc. As illustrated in FIG. 1, a plurality of hosts 21 (i.e., a host 1, a host 2, . . . , and a host N) may be connected to the image forming apparatus 10.

Each host 21 includes a second controller 23 and a user interface (UI) unit 25. The second controller 23 supplies an operation command for the image forming apparatus 10 and sets operations of the image forming apparatus 10. The UI unit 25 displays error information about the image forming apparatus 10 supplied by the image forming apparatus 10. The error information displayed on the UI unit 25 may include an error history of the image forming apparatus 10 and/or information about availability of each job mode. The error history may include a location of an error, a type of an error, and/or a number of times that an error has occurred. Accordingly, a user may easily identify an error status of the image forming apparatus 10. Furthermore, if the image forming apparatus 10 includes an error part (i.e., a part of the image forming apparatus that is causing errors), the UI unit 25 may display a job mode for replacing the error part, a partially-available job mode, etc. The job mode corresponds to a type of job supported by the image forming apparatus 10 and set by the host 21.

The error information stored in the storage unit 15 may be updated based on a detection result by detecting the error by mode and/or by operation part of the image forming apparatus caused when the image forming apparatus 10 operates. Also, the error information may be changed and/or initialized through the UI unit 25 by a user. Here, the image forming apparatus 10 may further include a user authorization unit 17 to authorize a user so that only an authorized user can change and/or initialize the error information stored in the storage unit 15. It is understood that the user authorization unit 17 may be provided in the host device 20 in addition to or rather than in the image forming apparatus 10.

In the image forming system according to aspects of the present invention, a user may easily identify the error history of the image forming apparatus 10, the availability of each job mode, etc., as the UI unit 25 displays information about whether the image forming apparatus 10 has an error. Also, in displaying the error information by the UI unit 25, if the error information of the image forming apparatus is displayed based on a job mode to be set among overall job modes, a configuration of the screen is simplified and a user may easily identify the error. If the image forming apparatus 10 has an error part, a job mode of replacing the error part is displayed by the UI unit 25 and the error part is avoided and replaced even before the error part is fixed.

Figure 2:
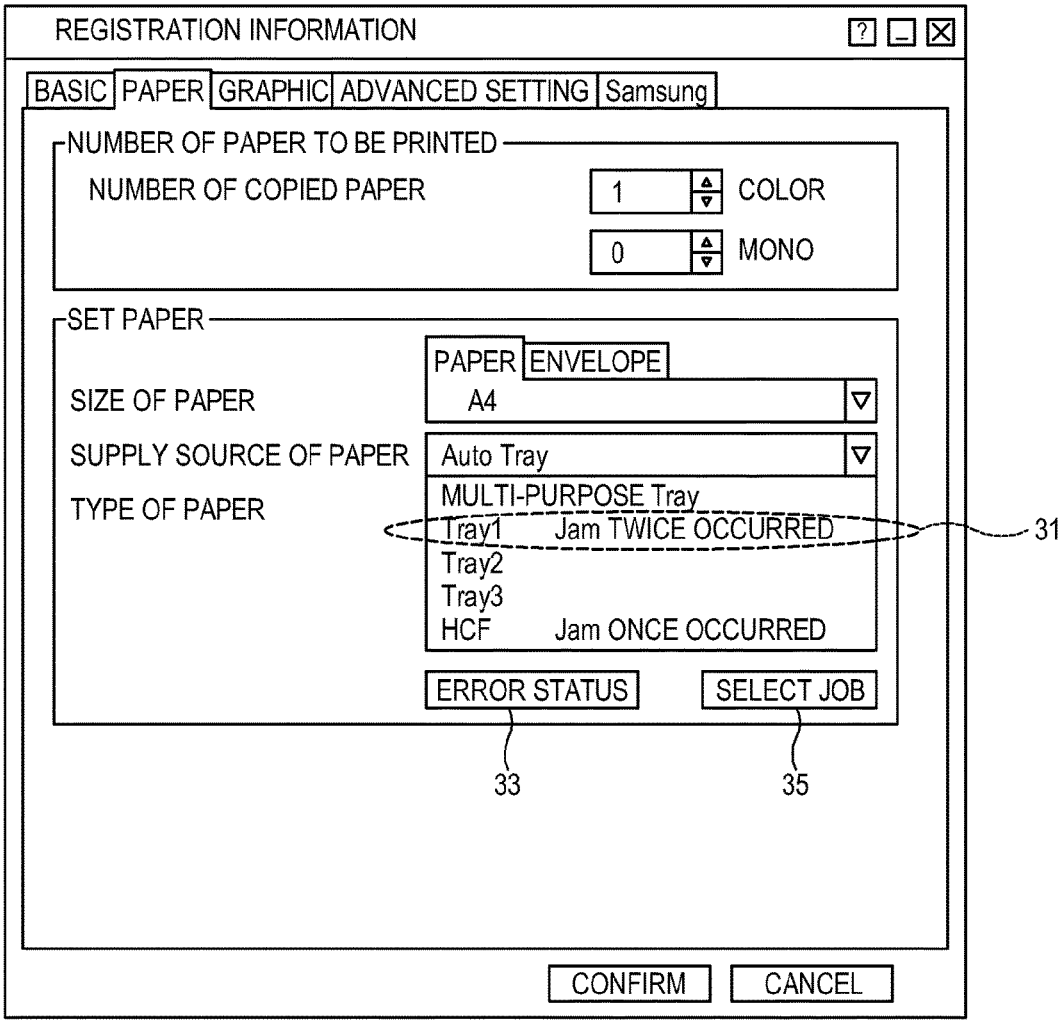

Hereinafter, the image forming system includes a network image forming apparatus 10 and a host 21 as an example. FIG. 2 illustrates an example of a menu screen displayed by a UI unit 25 of the host connected to the network image forming apparatus 10. Referring to FIG. 2, among registration information that represents properties of the image forming apparatus 10, a screen for paper settings includes information about a number of sheets of paper to be printed and a "set paper" option. Here, the "set paper" item includes "size of paper," "supply source of paper," and "type of paper" options. The "supply source of paper" item includes a type of an available paper feeding cassette and an error history. For example, in the image forming apparatus 10 that includes a "multi-purpose tray," "tray 1," "tray 2", "tray 3" and a high capacity feeder (HCF) as supply sources of paper, the error history is provided by the type of the supply source of paper. As illustrated, the tray 131 has a corresponding error history of "Jam twice occurred." It is understood that "paper" is provided as a non-limiting example of a print medium in the embodiment described with reference to FIG. 2.

The menu screen illustrated in FIG. 2 further includes an error status button 33 to request a detailed error status and a select job button 35 to change the job mode. For example, the select job button 35 is provided to change the error status of the tray 1 by a user. That is, if the cause of the jam of tray 1 is solved by replacing the error part (e.g. pickup roller) used in the tray 1, a user may reset the error status through the select job button 35.

Figure 3:
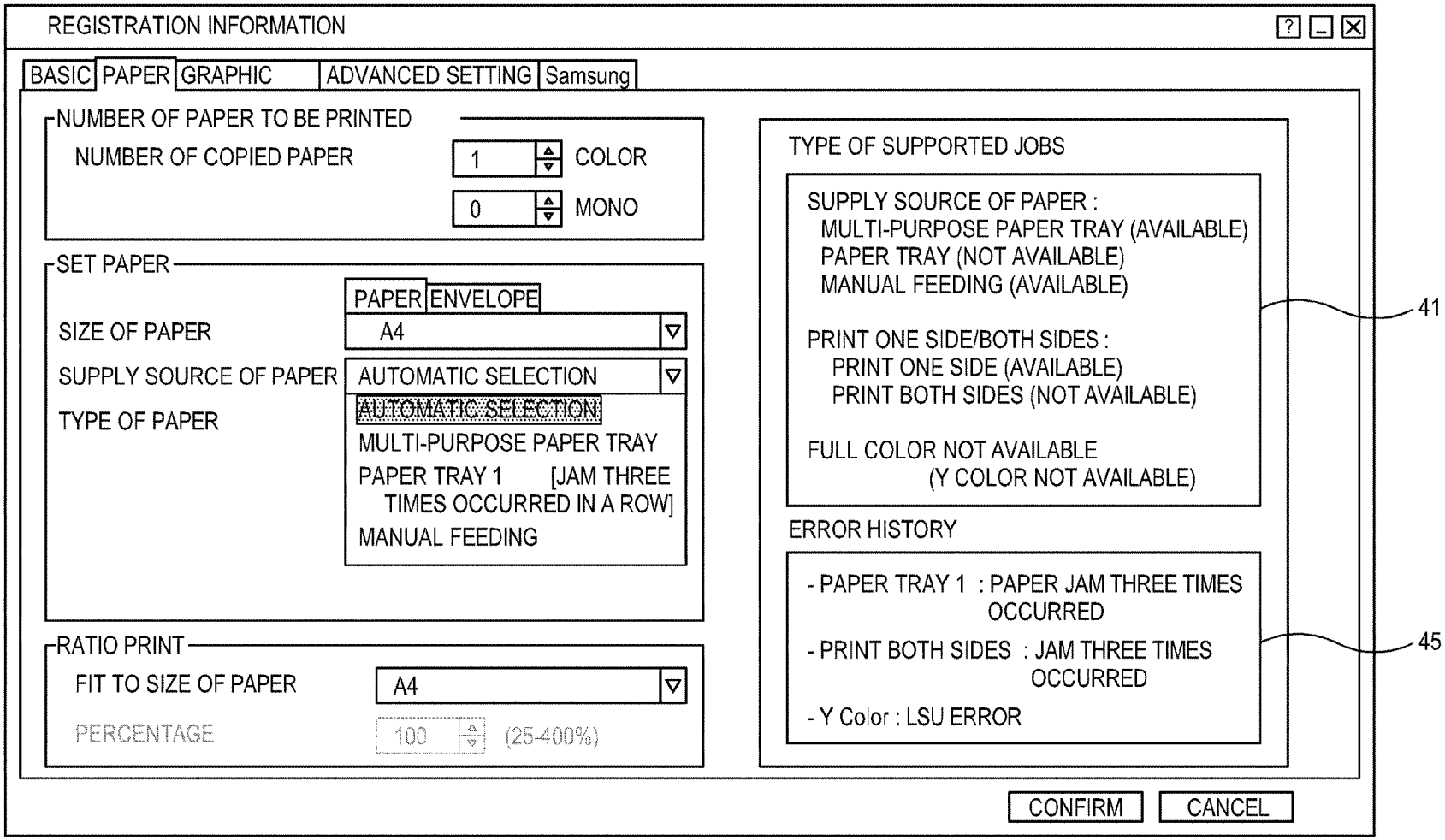

FIG. 3 illustrates another example of the menu screen displayed by the UI unit 25 of the host connected to the network image forming apparatus 10. Referring to FIG. 3, the "set paper" item includes "size of paper," "supply source of paper," and "type of paper" options. The "supply source of paper" item includes a type of an available paper feeding cassette and an error history. For example, the error history of a "paper tray 1" as one of the supply source of paper includes a simple description of "Jam three times occurred in a row." It is understood that "paper" is provided as a non-limiting example of a print medium in the embodiment described with reference to FIG. 3.

The screen for the paper settings, among registration information of the image forming apparatus 10, displays types of supported jobs 41 and an overall error history 45 of the image forming apparatus 10. As an example, these items of information may be displayed by selecting the error status button 33 in FIG. 2. The types of supported jobs 41 includes information on an availability of a "multi-purpose paper tray," a "paper tray," and a "manual feeding," among supply sources of paper. Here, the determination and display of the availability of the supply sources of paper may be performed by the first controller 13 of the image forming apparatus 10, the second controller 23 of the host device 20, and/or a user's selection (to be described later). As the availability of the supply sources is displayed among the types of supported jobs 41, a user may easily identify an available job and an unavailable job. Also, a user may select an available tray ("multi-purpose paper tray" or "manual feeding" in FIG. 3) when selecting the supply source of paper. Thus, even a job mode, from among a plurality of job modes, has an error from the image forming apparatus 10, another job mode that performs a same or similar operations may be selected to avoid repetitive errors.

As illustrated, the types of supported jobs 41 include "print one side/both sides," an item about the supply source of paper, and a full color item. Moreover, if the full color is not available, information about an unavailable color (for example, yellow) is provided. If the image forming apparatus 10 has an error in color printing, a mono printing may be performed even before a repair is done as the mono printing is available. It is understood that aspects of the present invention are not limited to the types of supported jobs 41 illustrated in FIG. 3. That is, according to other aspects, additional and/or alternative items may be provided. For example, if the image forming apparatus 10 is not a color image forming apparatus, the full color item may not be provided.

Furthermore, as illustrated, the error history 45 includes an error history about each of the unavailable items among the types of supported jobs 41 (in the example illustrated in FIG. 3, the "paper tray 1," "print both sides," and "Y color"). Specifically, the "paper tray 1" includes a history of "paper jam three times occurred," the "print on both sides" includes a history of "jam three times occurred," and Y color includes an error history that indicates an error of a light scanning unit (LSU). If the image forming apparatus 10 has an error, overall operations may not be performed depending on the type of the error. In this case, the unavailability of the overall jobs is displayed by the UI unit 25 of the host 21 connected via the network, so as to be quickly fixed and to avoid repetitive errors.

FIG. 4 illustrates another example of the menu screen displayed by the UI unit 25 of the host 21 connected to the network image forming apparatus. Referring to FIG. 4, the menu screen displays locations of error, a number of times each type of error occurs, an occurrence date of each error, and replaced job information by an element of the image forming apparatus 10. For example, the location of each error may be classified into a paper path, a location of trays (tray 1, tray 2, and tray 3), a fuser, a light scanning unit (LSU), a duplex automatic document feeder (DADF), a finisher, a booklet maker, and an inserter, though aspects of the present invention are not limited to this classification method. Here, each location of error has corresponding type(s) of error and the number of times each type of error occurs. For example, the fuser has, as corresponding types of errors, a fusing unit error, a fusing thermistor error, and a lowered heating error. Among the errors, if the lowered heating error occurs once, "1" is displayed. If information is not displayable on a single screen, a selection button to display the information may be provided (for example, a "Where" button 51, a "When" button 53, and an "Info" button 55). It is understood that "paper" is provided as a non-limiting example of a print medium in the embodiment described with reference to FIG. 4.

FIG. 5 illustrates an example of a menu screen displayed by the UI unit 25 of the host 21 for information about paper trays among job selection information supplied to a user. It is understood that "paper" is provided as a non-limiting example of a print medium in the embodiment described with reference to FIG. 5. Referring to FIG. 5, paper size, error status, error information, and error status change information are shown for each paper tray. The error status may be changed between "available" and "not available" through manipulation of an error status button 63 by a user. For example, if the tray 1 is not available due to an error of a pickup roller, the tray 1 may be used after replacing the pickup roller. Meanwhile, the error status may still display "not available." In this case, a user may change the error status into "available" through the change button 63. For example, a user authorization screen may be displayed by the UI unit 25 so that only an authorized user can change the error status. Furthermore, an error information button 61 is provided so that a user can select a display of detailed error information for the corresponding paper tray. It is understood that the error information and the error status information for each paper tray are described as examples of the job selection information, and aspects of the present invention are not limited thereto. According to other aspects, color, duplexer operation, and type of additional jobs (e.g., punch, stapler, offset and booklet maker) may also or alternatively be represented.

Figure 6:
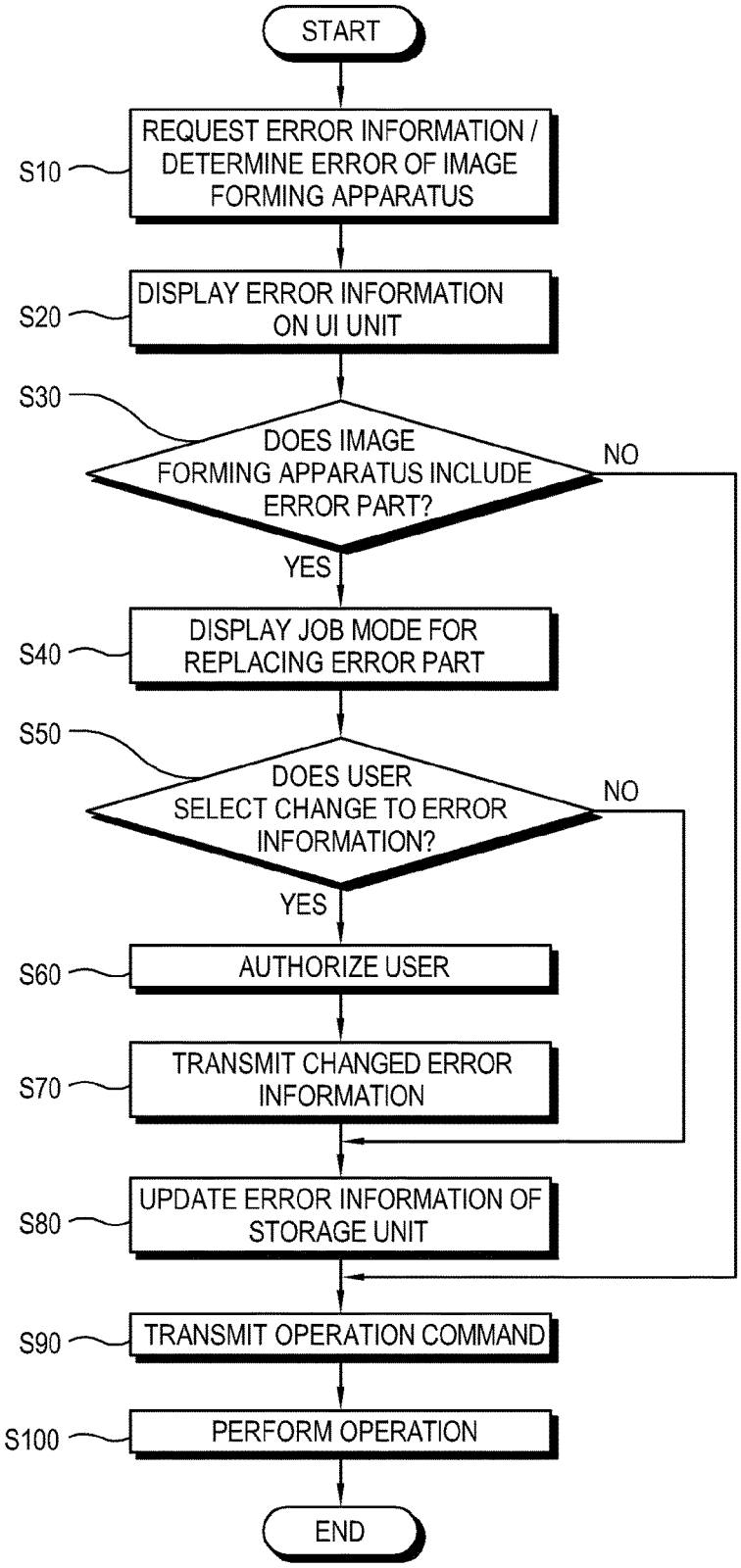
FIG. 6 is a flowchart to describe a control method of an image forming system according to an embodiment of the present invention.

Hereinafter, a control method of the image forming apparatus 10 and the host device 20 connected to the image forming apparatus 10 according to aspects of the present invention will be described in detail. FIG. 6 is a flowchart to describe a control method of the host device 20 according to an embodiment of the present invention. Referring to FIGS. 1 and 6, the control method includes an operation of the image forming apparatus 10 that is connected to the host device 20 through a network. Referring to FIG. 6, error information about the image forming apparatus 10 is requested by the host device 20 in operation S10. Accordingly, the error information received from the image forming apparatus 10 is displayed by the UI unit 25 of the host device 20 in operation S20.

Specifically, in the operation S10, the image forming apparatus 10 may determine the error of the image forming apparatus 10 in the warming-up stage and inform the host device 20 of the determined error information in response to the host device 20 requesting the error information. However, it is understood that aspects of the present invention are not limited thereto. That is, according to other aspects, the image forming apparatus 10 may determine the error thereof in other stages, aside from the warming-up stage, and/or the image forming apparatus 10 may transmit the determined error information automatically (i.e., without receiving a request from the host device 20). Moreover, the image forming apparatus 10 may supply the error information stored in the storage unit 15. Furthermore, the error information may be updated by determining the status of the image forming apparatus 10 at predetermined periods or according to a user's request, and the updated error information may be supplied.

Here, the error information may include the error history of the image forming apparatus 10 and/or information about the availability of each job mode. For example, as described with reference to FIGS. 1 to 5, the information about the image forming apparatus 10 may include a job mode related to the print medium tray and print medium path of the print medium, a job mode related to the developing, transferring and fusing operations to form images, and/or an additional job mode such as a duplexer and a finisher. As described with reference to FIGS. 2 to 5, the error history of the image forming apparatus 10 may include a location of each error, a type of each error, and/or a number of times each error has occurred.

In the operation S20 of displaying the error information, the error information of the image forming apparatus 10 with respect to a job mode to be set in the host device 20 is displayed. In this case, a screen provided by the UI unit 25 is simple and a user may easily identify the error information.

Whether the image forming apparatus 10 includes an error part (i.e., a part of the image forming apparatus 10 that is causing errors) is determined in operation S30. If the image forming apparatus 10 includes an error part (operation S30), a job mode to replace the error part is displayed by the UI unit 25 in operation S40.

The control method according to the embodiment of the present invention may further include an operation of changing or initializing the error information stored in the storage unit 15 through the UI unit 25. That is, a user may determine whether to change (or initialize) the error information in operation S50, such that the changed error information is transmitted from the host device 20 to the image forming apparatus 10 in operation S70, and the error information of the storage unit 15 is updated (i.e., changed or initialized) in operation S80.

Furthermore, if the user determines to change the error information (operation S50), the user is authorized before transmitting the changed error information (operation S70) in operation S60 to change or initialize the error information stored in the storage unit 15.

If a user determines to not change the error information (operation S50), the error information of the storage unit 15 is updated according to the error information included in the image forming apparatus 10 (i.e., the operations S60 and S70 are not performed).

As described above, an operation command is transmitted from the host device 20 to the image forming apparatus 10 in operation S90 after the error information is updated (operation S80), and the image forming apparatus 10 performs the operation in operation S100.

While not restricted thereto, aspects of the present invention can also be embodied as computer-readable code on a computer-readable recording medium. The computer-readable recording medium is any data storage device that can store data that can be thereafter read by a computer system. Examples of the computer-readable recording medium include read-only memory (ROM), random-access memory (RAM), CD-ROMs, magnetic tapes, floppy disks, and optical data storage devices. The computer-readable recording medium can also be distributed over network-coupled computer systems so that the computer-readable code is stored and executed in a distributed fashion. Aspects of the present invention may also be realized as a data signal embodied in a carrier wave and comprising a program readable by a computer and transmittable over the Internet.

As described above, a control method of a host device 20, an image forming system, and an image forming apparatus according to aspects of the present invention notifies a user of an error of the image forming apparatus through a UI unit 25 connected to a network. Thus, a user may easily identify whether a remote image forming apparatus 10 has an error. If the image forming apparatus 10 has a partial error, and a replacement job mode is present, the image forming apparatus 10 may still be used by avoiding the error part. Thus, use efficiency of the image forming apparatus 10 is improved. If an error that causes overall operations of the image forming apparatus 10 to be unavailable occurs, the UI unit 25 may display the unavailability of the overall operations for a user. Thus, a user may quickly determine the timing of repairing or replacing the error part. According to aspects of the present invention, the error information of the image forming apparatus 10 may be displayed by the UI unit 25 for a job mode to be set among a plurality of job modes. In this case, a configuration of the error information screen is simple and a user may easily identify the error information.

Although a few embodiments of the present invention have been shown and described, it will be appreciated by those skilled in the art that changes may be made in this embodiment without departing from the principles and spirit of the invention, the scope of which is defined in the claims and their equivalents.

What is claimed is:

1. A control method of a host device connected to an image forming apparatus, the control method comprising:

requesting, by the host device, error information from the image forming apparatus; and displaying the received error information on a user interface unit of the host device, wherein the error information comprises an error history of the image forming apparatus and information about an availability of each job mode of the image forming apparatus and the information about an availability of each job mode is displayed separately from the error history, the job mode corresponding to one of a type of job supported by the image forming apparatus and a type of job set by the host device.

2. The control method of the host device as claimed in claim 1, wherein the error information further comprises an error history of the image forming apparatus, wherein the error history of the image forming apparatus comprises a location in the image forming apparatus of an error, a type of the error, and/or a number of times that the error has occurred.

3. The control method of the host device as claimed in claim 1, wherein the displaying of the received error information comprises displaying the error information for the job mode to be set in the host device.

4. The control method of the host device as claimed in claim 1, wherein the displaying of the received error information comprises displaying the job mode corresponding to an error part of the image forming apparatus on the user interface unit.

5. The image forming system as claimed in claim 4, wherein the displaying of the received error information further comprises displaying a replacement job mode and/or an available job mode for the error part of the image forming apparatus, the replacement job mode performing a same operation to a job mode that is unavailable due to the error part.

6. The control method of the host device as claimed in claim 1 wherein the error information is supplied by a storage unit of the image forming apparatus storing the error information of the image forming apparatus in response to the host device requesting the error information of the image forming apparatus.

7. The control method of the host device as claimed in claim 6, wherein the error information that is stored in the storage unit is updated according to an error that is determined by the image forming apparatus when the image forming apparatus operates, and/or changed or initialized according to a user input to the host device.

8. The control method of the host device as claimed in claim 1, wherein the user interface unit comprises a user interface of a printer driver and/or a user interface of an application executed by the host device.

9. An image forming system to provide error information to a user, the image forming system comprising:

an image forming apparatus comprising:

a storage unit to store the error information of the image forming apparatus, and a first controller to transmit the stored error information; and a host device comprising:

a receiving unit to receive the transmitted error information, a second controller to provide an operation command for the image forming apparatus and to set an operation of the image forming apparatus, and a user interface unit to display the received error information of the image forming apparatus according to a job mode of the image forming apparatus, wherein the error information comprises an error history of the image forming apparatus and information about an availability of each job mode of the image forming apparatus and the information about an availability of each job mode is displayed separately from the error history, the job mode corresponding to one of a type of job supported by the image forming apparatus and a type of job set by the host device.

10. The image forming system as claimed in claim 9, wherein the error history of the image forming apparatus comprises a location in the image forming apparatus of an error, a type of the error, and/or a number of times that the error has occurred.

11. The image forming system as claimed in claim 9, wherein the user interface unit displays a replacement job mode and/or an available job mode for an error part of the image forming apparatus, the replacement job mode performing a same operation to a job mode that is unavailable due to the error part.

12. The image forming system as claimed in claim 10, wherein the error information that is stored in the storage unit is updated according to an error that is determined by the image forming apparatus when the image forming apparatus operates and/or changed or initialized according to a user input to the host device.

13. The image forming system as claimed in claim 9, wherein the user interface unit comprises a user interface of a printer driver and/or a user interface of an application executed by the host device.

14. An image forming apparatus that is connected to a host device having a user interface unit displaying information supplied by the image forming apparatus, the image forming apparatus comprising:

a storage unit to store error information of the image forming apparatus, wherein the error information comprises information about an availability of each job mode of the image forming apparatus; and a controller to supply the stored error information to the host device so that the error information is displayable on the user interface unit according to a job mode of the image forming apparatus and the information about an availability of each job mode is displayed separately from an error history of the image forming apparatus, the job mode corresponding to one of a type of job supported by the image forming apparatus and a type of job set by the host device.

15. The image forming apparatus as claimed in claim 14, wherein the error history comprises a location in the image forming apparatus of an error, a type of the error, and/or a number of times that the error has occurred.

16. The image forming apparatus as claimed in claim 14, wherein the error information that is stored in the storage unit is updated according to an error that is determined by the image forming apparatus when the image forming apparatus operates and/or changed or initialized according to a user input to the host device.

17. A host device that is connected to an image forming apparatus that supplies error information to the host device, the host device comprising:

a controller which provides an operation command for the image forming apparatus and sets an operation of the image forming apparatus; and a user interface unit to display the supplied error information of the image forming apparatus according to a job mode of the image forming apparatus, wherein the error information comprises an error history of the image forming apparatus and information about an availability of each job mode of the image forming apparatus and the information about an availability of each job mode is displayed separately from the error history, the job mode corresponding to one of a type of job supported by the image forming apparatus and a type of job set by the host device.

18. The host device according to claim 17, wherein the user interface unit displays a replacement job mode and/or an available job mode for an error part of the image forming apparatus, the replacement job mode performing a same operation to a job mode that is unavailable due to the error part.

19. The host device according to claim 17, wherein the user interface unit comprises a user interface of a printer driver and/or a user interface of an application executed by the host device.

20. The host device as claimed in claim 17, wherein the error history of the image forming apparatus comprises a location in the image forming apparatus of an error, a type of the error, and/or a number of times that the error has occurred.

21. The host device as claimed in claim 17, wherein the controller authorizes a user such that the error information is changed or initialized according to the user input of an authorized user to the host device.

* * * * *